United States Patent [19]

Guerreri

[11] Patent Number: 4,884,506

[45] Date of Patent: Dec. 5, 1989

[54] REMOTE DETONATION OF EXPLOSIVE CHARGES

[75] Inventor: Carl N. Guerreri, Manassas, Va.

[73] Assignee: Electronic Warfare Associates, Inc., Vienna, Va.

[21] Appl. No.: 927,362

[22] Filed: Nov. 6, 1986

[51] Int. Cl.[4] ..... F42C 15/40; F42D 3/00

[52] U.S. Cl. ..... 102/200; 102/202.1

[58] Field of Search ..... 102/200, 202.1, 221, 102/420, 427, 202.2

[56] References Cited

U.S. PATENT DOCUMENTS

| | | | |
|---|---|---|---|
| 2,411,787 | 11/1946 | Hammond, Jr. | 102/427 |
| 2,918,001 | 12/1959 | Alford | 102/202.2 |
| 3,370,140 | 2/1968 | Betts | 102/202.2 |
| 3,750,586 | 8/1973 | Swallow et al. | 102/427 |
| 4,145,970 | 3/1979 | Hedberg et al. | 102/206 |
| 4,527,480 | 7/1985 | Carp | 102/202.1 |
| 4,576,093 | 3/1986 | Snyder | 102/200 |

OTHER PUBLICATIONS

Blasters Handbook, E. I. du Pont de Nemours & Co. (Inc.), 1977, pp. 87–91, 138–149, 152–159, 174–193 and 396–403.

*Primary Examiner*—Deborah L. Kyle
*Assistant Examiner*—Michael J. Carone
*Attorney, Agent, or Firm*—Roland H. Shubert

[57] ABSTRACT

Explosive charges are detonated by remote control in environments having high levels of extraneous electric and electromagnetic energy by providing a separate control unit for each explosive charge. The control unit accepts coded commands radio transmitted from a command unit and, if those commands meet with pre-set criteria, the control unit detonates the charge. Each control unit is connected to its respective explosive charge by electrical or optical conductors providing sufficient separation as to allow the control unit to survive detonation of the charge without damage.

19 Claims, 4 Drawing Sheets

REMOTE DETONATION OF EXPLOSIVE CHARGES

BACKGROUND OF THE INVENTION

This invention relates generally to devices and methods for remotely detonating one or move explosive charges.

More specifically this invention relates to the precisely timed, remote detonation of explosive charges using electrical detonators in environments having high levels of extraneous electricity including stray ground currents, electromagnetic fields and radio frequency energy.

It has become increasingly common for hostages to be taken during criminal activity or in the commission of terrorist acts. Concern for the safety of hostages has ordinarily inhibited or precluded the use of force by the responsible authorities. When force is employed, it is necessary to act with precise timing so as to prevent, or minimize, any retaiatory action on the part of the terrorists toward the hostages.

In many instances, any effective response by the authorities requires the use of explosives, as for example, to breach a wall, to sever the hinges or lock of a door, to create a diversion, to disperse smoke or disabling gases, or for other analogous purposes. Ordinarily, a number of different types or sizes of explosive devices situated at different locations are desirably employed. There are immense practical difficulties involved in the physical placement of explosive devices under such conditions and the time that might be required to accomplish such placement is ordinarily difficult to predict. Also, hostage-taking events often display rapidly changing circumstances. Consequently, it is impractical and frequently undesirable to place an explosive charge having a fixed, or preset, time of detonation.

The remote detonation of explosive charges is, of course, well known and commonly practiced in commercial and industrial blasting. Explosive charges are most commonly detonated using electric blasting caps as initiators. Non-electric blasting caps for use with safety fuse and detonating cord are also routinely used explosive charge initiators.

None of these conventional techniques for detonating explosive charges is satisfactory for use in terrorist situations. Most terrorist acts and hostage-taking events occur in urban and highly congested areas. Such areas normally contain high levels of extraneous electricity, especially stray ground currents, electromagnetic fields associated with transmission lines, and radio frequency energy from TV and radio transmission and the like. This background electrical energy is ordinarily substantially increased by the high concentration of communications and surveillance devices which converge on the area in response to a terrorist act. It is well known that radio frequency current induced in a blast wiring circuit can initiate electric blasting caps. Consequently, safety considerations require that electric blasting not be attempted in areas where extraneous currents are greater than about 50 milliamperes.

When extraneous currents exceed about 50 milliamperes, standard safety precautions require use of a non-electric initiating system. Those non-electric systems comprising blasting caps and safety fuse are time consuming to rig and, after being rigged, are quite inflexible. It is, for example, difficult to change the sequence of detonation, to precisely control the timing of detonation, and to change the time delay between individual charges. Also, there is a finite time delay between ignition of the fuse and detonation of the corresponding explosive charge.

Because of the safety, environmental and timing requirements and restraints placed upon explosives use in terrorist and hostage-taking events, conventional blasting techniques are of little value. Yet, the judicious use of explosives offers a very effective tool in suppressing terrorist activities.

SUMMARY OF THE INVENTION

The remote detonation of explosive charges, especially in environments having high levels of extraneous electricity, is accomplished by providing an individual control unit for each explosive charge. Each control unit is short-coupled to its respective charge in a manner which prevents the generation of an induced current in the detonating circuit and is arranged to arm and to detonate the charge only in response to a plurality of radio-transmitted coded commands in proper sequence and repeated with proper frequency. The control units are arranged so that each must be placed in an armed state by coded command before it will accept a command to detonate the charge and failure of a unit to continuously receive a command to arm prevents its acceptance of a command to detonate the charge.

Hence, it is an object of this invention to provide means and techniques for the remote detonation of explosive charges especially in areas exposed to high levels of extraneous electricity.

Other objects of this invention will be evident from the following description of certain preferred embodiments of the invention.

BRIEF DESCRIPTION OF THE DRAWINGS

The Drawing illustrates certain preferred embodiments of the invention in which:

FIG. 4-A shows a preferred format for the coded control messages passed from the command unit causing individual control units to arm and fire;

FIG. 6-A shows the arrangment of the switch of FIG. 6 in an activated or "fire" position.

DESCRIPTION AND DISCUSSION OF THE INVENTION

Figure 1:
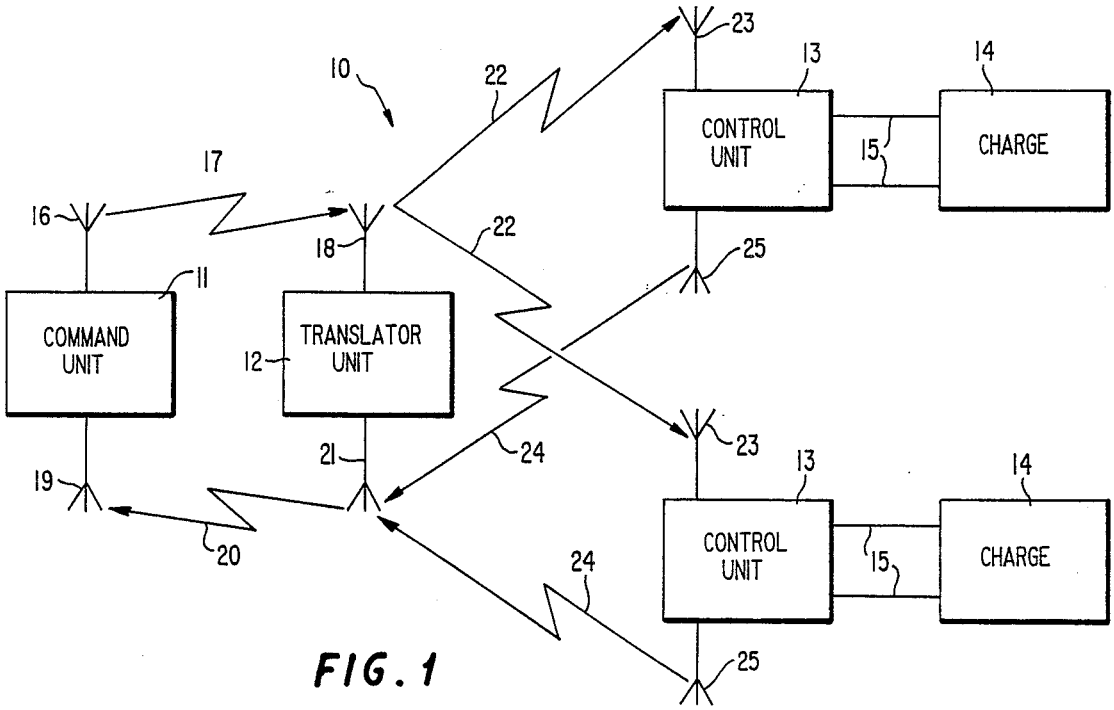
FIG. 1 is a schematic diagram illustrating the major sub-systems of the invention and their interaction.

The remotely controlled detonating system of this invention will be described in relation to its use in an urban area for law enforcement purposes. Referring first to FIG. 1, there is shown a generalized, functional diagram of the system of this invention together with the major sub-systems and their interaction.

In a preferred embodiment, the detonating system of this invention shown generally at 10, includes three major sub-systems. One of the sub-systems is a command unit 11 which includes a command console, radio transmitters and receivers and microprocessors. A second sub-system comprises a translator unit 12 which is designed to act as a relay point between the command unit land one or more individual control units 13. The functions of translator unit 12 can be incorporated into the command unit 11 but that arrangement is much less preferred. Provision of a translator unit, as is illustrated, ensures a very strong signal for the individual control units 13 independent of multi-path reflections, transmitter fading and other radio propagation phenomena that may exist. It also allows transmitters in the individual control units 13, used to feedback status information to the command unit, to be low powered thus allowing reduced size and complexity.

Each individual control unit 13 contains a radio receiver which receives signals from the command unit 11 relayed through the translator 12. Individual control units also contain firing logic and firing mechanisms for detonating an explosive charge 14. Charge 14 is connected to its control unit by means of signal transmitting means 15 which may be an electrical wire conductor or in certain embodiments, may be an optical fiber. Wire 15 is made sufficiently long, typically five to fifteen feet, so as to ensure that control units 13 survive the blast of charge 14 without damage.

In a preferred mode, command unit 11 is provided with antennas 16, for transmission of radio signal 17 for reception by antenna 18 of translator 12, and 19 for the reception of radio signal 20 broadcast by translator antenna 21. Translator 12 is also arranged to broadcast signals 22, which may be a relay of signal 17, for reception by individual control units 13 through antennas 23. In a similar fashion, control units 13 are arranged to broadcast a signal 24, representative of system status, by means of antennas 25.

Figure 2:
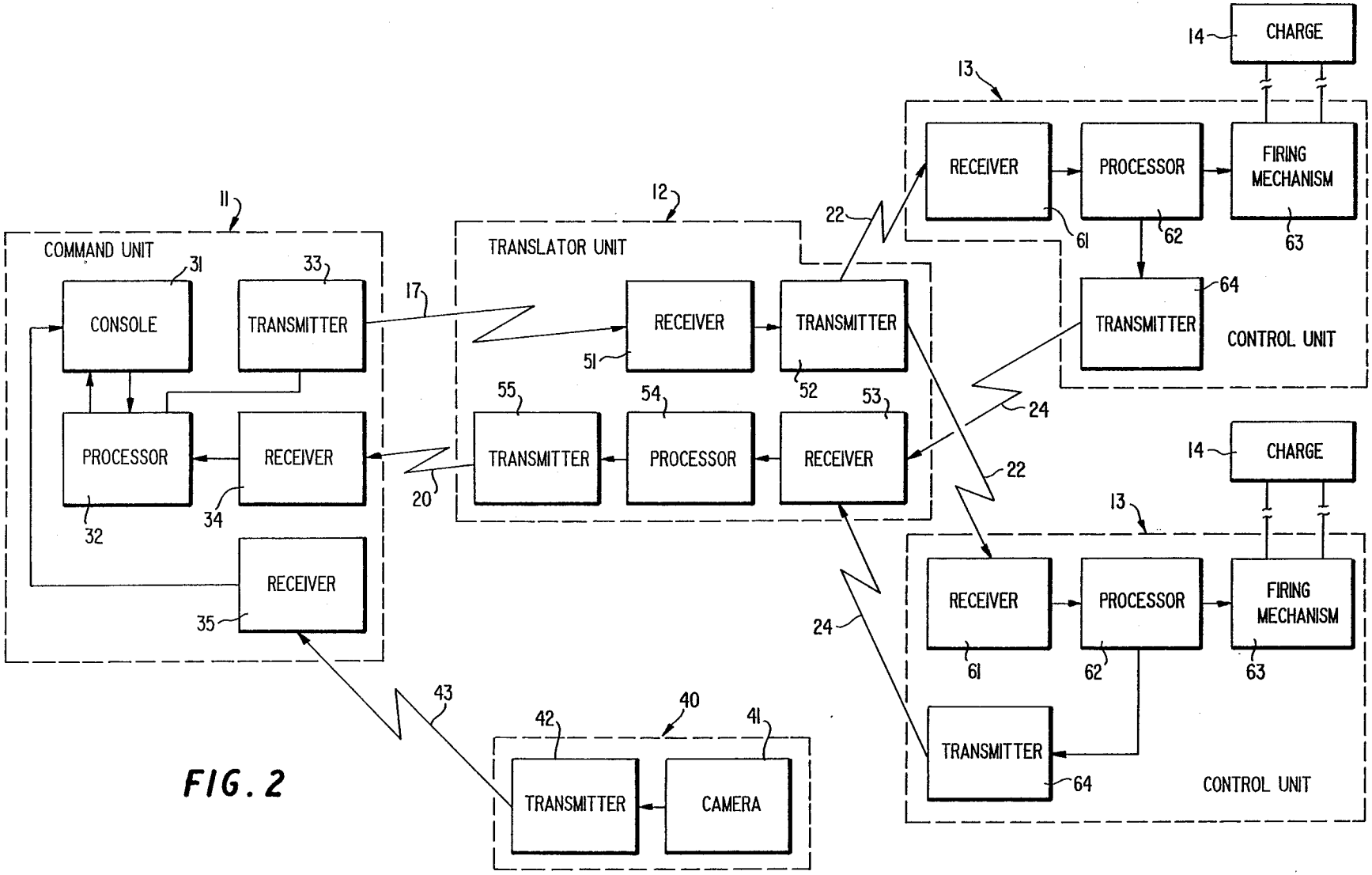
FIG. 2 is a system functional diagram further illustrating its operation.

FIG. 2 shows the components making up each subsystem in greater detail. Referring now to that Figure, command unit 11 is shown in dashed outline and includes a command console 31, a processor 32, a radio transmitter 33 and a radio receiver 34. Both transmitter 33 and receiver 34 are preferably FM. Console 31 is arranged so as to allow an operator to determine the status of any or all of the individual control units and to command the arming, disarming or firing of any or all of the explosive charges 14 either simultaneiously or in any timed sequence. The system is designed such that a disarm command will override all else.

There is also illustrated an optional sub-system 40, not shown in FIG. 1, comprising a closed circuit television camera 41 and an associated transmitter 42. Camera 41 may be used to monitor the locations of charges 14 and transmit that picture back to closed circuit television receiver 35 via signal 43. The picture may be displayed on a video monitor incorporated in command console 31.

Translator sub-system 12 includes and FM radio receiver 51 which is adapted to pick up signal 17 produced by command unit transmitter 33.

That signal is fed to FM transmitter 52 where it is re-broadcast as signal 22 directed to individual control units 13. Subsystem 12 also includes an AM radio receiver 53 to pick up signal 24 from individual control units 13. That singal is passed to encoding-decoding processor 54 which produces a data stream re-broadcast as signal 20 by FM transmitter 55.

Each individual control unit 13 is provided with a command receiver 61 which is adapted to receive either the command unit signal 17 or the re-broadcast signal 22 from translator 12. That radio signal is passed to a processor-decoder means 62 which is shown in greater detail in FIG. 3. Processor-decoder 62 functions to arm and activate firing mechanism 63, upon proper command, thus detonating explosive charge. Means 62 also performs housekeeping functions including reporting on the status of mechanism 63 and coding that status information for transmission back to translator 12 via radio signal 24 broadcast by transmitter 64.

Figure 3:
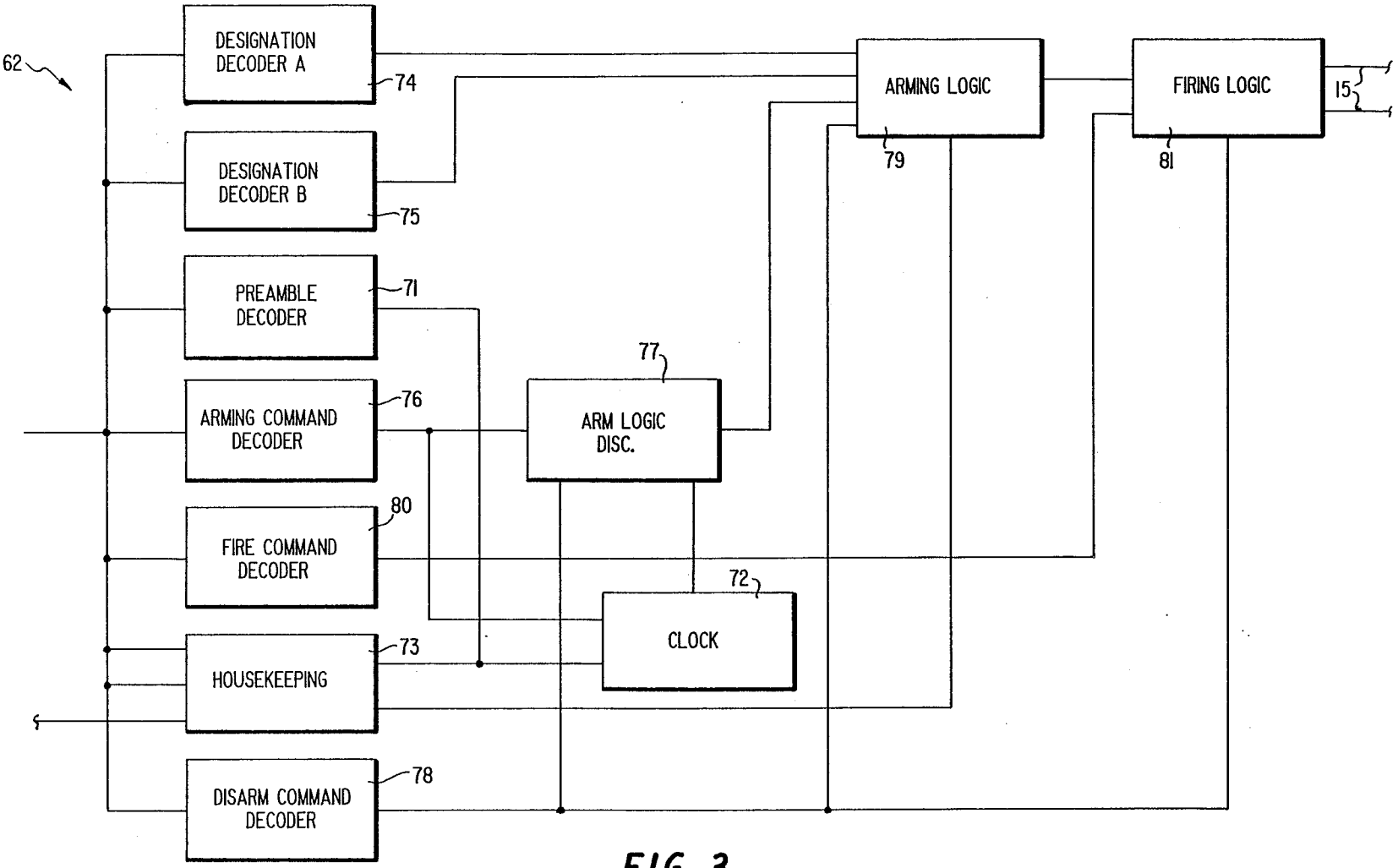
FIG. 3 illustrates the components of an individual control unit processor.

Turning now to FIG. 3, there is shown in diagrammatic block form the components of a processor-decoder module 62 of an individual control unit 13. Module 62 is designed to accept and respond to messages from the command unit 11, including those relayed through translator 12, to arm, disarm, or fire the explosive charge 14 associated with each individual control unit. All such messages between the command unit and the individual control units must be absolutely distinctive so that the chances of an individual control unit responding to some random signal, or to a signal directed to another individual control unit, is essentially zero. Consequently, each individual control unit is provided with an identifying code which, in a preferred embodiment, is a Mersenne prime number.

Figure 4:
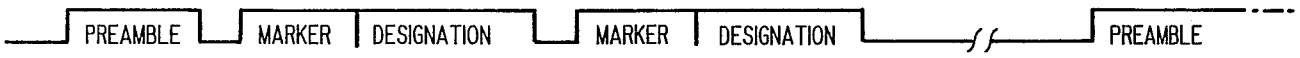
FIG. 4 shows one preferred format for the coded control messages passed between the command unit and the individual control unit when the latter are in a "ready" state.
Figure 4A:
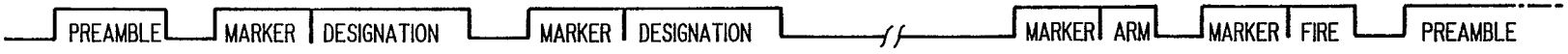

FIGS. 4 and 4-A provide examples of preferred formats of the coded messages. Referring now to FIGS. 3, 4 and 4-A, a message includes a preamble and a designation code sequence as is diagrammed in FIG. 4. The preamble is processed by preamble decoder 71 and is used for synchronization of clock 72 with that of the command unit and to alert housekeeping module 73 to be ready to accept data. Following the preamble is a designation code sequence consisting of a marker identifying the beginning of a message and the designation itself. As was set out previously, the designation preferably is a Mersenne prime number. After the designation of a first individual control unit is completed, the designation of a second control unit is transmitted and so on until all desired individual control units have been alerted.

In one preferred embodiment, the preamble and designation portions of the message are 15-bit binary words corresponding to a Mersenne prime number. Redundancy is built into the system to further reduce the possibility of the control units responding to a spurious signal. That is accomplished by the transmission of at least two separate destination codes multiple times. A first designation decoder 74 and a second designation decoder 75 are provided to process the separate message codes and each decoder must correctly receive its transmitted code four out of five times in order for module 62 to recognize a valid designation. Summarizing those requirements, an individual control unit is placed on an alert status only after it has received two separate specific messages, each 15 bits long, in four out of five transmissions.

To further illustrate operation of the system, presume that a total of twenty explosive charges, each with its own individual control unit, have been placed into position. The responsible official in charge of the operation and controlling the central command unit 11 determines from either external intelligence sources or from the closed circuit visual observation system 40 which charges he desires to detonate and in what order. He then enters that data into the system using the command console 31 (FIG. 2) of command unit 11. The processor 32 of the command unit receives this information and generates a coded message to be transmitted to translator 12 for relay to the individual control units.

Presume further that the twenty charges and their control units are numbered sequentially and that four of the charges, numbers 3, 11, 12 and 17, are designated for simultaneous detonation. Upon receiving the message preamble, the clock 72 of each of the twenty individual control units is synchronized with the clock of the command unit and each control unit then watches to see if its designations are being transmitted. The stream of digital data from the receiver 61 of each individual control unit is fed to module 62. Each of the twenty individual control units has a specific prime number for each decoder, or two prime numbers per unit, which it is set to recognize. The sets of prime numbers corresponding to each of control units 3, 11, 12 and 17 are broadcast in the signal format illustrated in FIG. 4. If both decoders 74 and 75 recognize their respective prime numbers in at least four of five transmissions, then the individual control unit is placed on alert status where it can accept further instructions. At that point, a signal is sent to the housekeeping component 73 indicating that its individual control unit has been designated by the command unit. Component 73 then sends a message to transmitter 64, confirming the decision, for broadcast back to translator 12. That information is decoded, combined with similar information from the other individual control units, and is transmitted back to the command unit.

When the message is received by the command unit, it is decoded in processor 32 and displayed on the command console 31. That console preferably includes visual indication of the status of each individual control unit. In this case, the console would show by appropriate indicia that control units 3, 11, 12 and 17 were in an alert status while the remaining sixteen units were inactive.

As long as the four individual control units designated to be on alert status remain so designated, encoded messages are transmitted continuously to the individual control units and those units continuously transmit confirmations back to the command unit. Control units under an alert status may be removed from that status by the official in charge at will and other units can be designated.

Should the official decide that he may need to detonate the explosive charges, he then causes the status of the four designated control units to change from an alert to an armed state. This is accomplished by activating an arm switch on the command console which causes the message being transmitted to the control units to change to the format shown in FIG. 4-A. The new message format includes a 20-bit binary word which commands the individual control unit to arm its circuits. This new message is received and processed in the arming command decoder 76 which in turn transmits the command to the arm logic discriminator 77.

Arm logic discriminator 77 performs two functions. First, it monitors the status of the system to ensure that a disarm command has not been issued. The official in control of the command console always has the ability to transmit a disarm signal. That signal is received and processed in the disarm command decoder 78 and the command is then transmitted to the arm logic discriminator 77. Discriminator 77 is arranged so as to give a disarm signal a higher priority than an arm signal. A disarm command prevents discriminator 77 from passing the command through to the arming logic circuit 79.

The second function of the arming logic discriminator 77 is to keep track of how long it has been since the last arming command was received. The system is designed so that it must receive a new arm command periodically else it reverts back to the alert status. Preferably, a new arm command must be received once every three frames of data for the system to remain armed. If the arming logic discriminator determines that the arming command is valid, that there has been no disarm command and that the arming command has occurred frequently enough, it then passes positive confirmation of arming to the arming logic circuit 79.

When the system is armed, the housekeeping component 73 of the processor 62 monitors the arming logic circuit 79 and determines that the individual control unit is in the armed mode. It encodes this data and sends it back to the command unit where the command console 31 provides the responsible official with visual confirmation that the arm signal has been received by the designated individual control unit. The visual confirmation may, for example, take the form of a status light provided for each individual control unit which will be illuminated whenever the unit is in an armed status.

At this point, the only thing yet required to cause the designated individual control units to detonate their respective explosive charges is to transmit a firing command. If prior to issuing a fire command the responsible official decides to disarm the designated units, he is provided a disarm the designated units to come out of the arm position and revert back to an alert status. Alternatively, the system allows for each or all of the individual control units to be de-designated by appropriate command thus providing redundancy in the disarming circuits.

The explosive charges associated with their respective individual control units, in this example units 3, 11, 12 and 17, can now be detonated at will by the activation of a fire switch located at the command console 31. That will cause a fire command to be encoded on the data stream in a format such as is diagrammed in FIG. 4-A. The command is transmitted to the individual control units where it is detected and decoded by the fire command decoder 80 of processor 62. If decoder 80 recognizes the fire command as authentic, it transmits a fire signal to firing logic module 81. If, at the time the fire signal is received by firing logic module 81, there is a positive output from the arming logic 79 and there is no disarm signal present the firing logic will issue a firing command. This fire command is transmitted through electrical or optical conductors 15 to a mechanism for detonating the charge.

The firing mechanism itself is of conventional type and preferably comprise a capacitor discharge blasting machine. Such devices are well known and comprise a capacitor which stores a quantity of electricity. The capacitor is discharged into the firing circuit upon activation of a firing switch causing an electric blasting cap to detonate the explosive charge.

Figure 5:
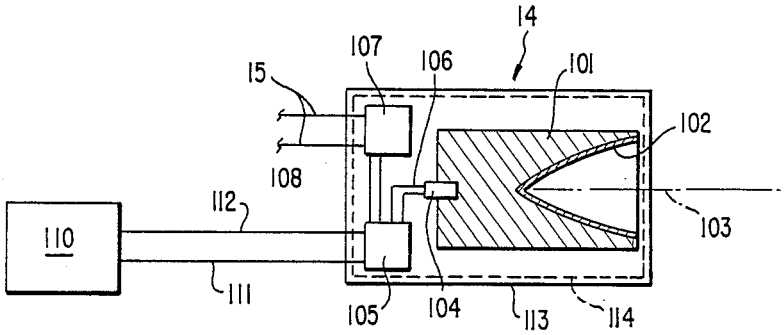
FIG. 5 depicts in partial section an explosive charge arrangement advantageously used in the invention.

Turning now to FIG. 5, there is shown one preferred arrangement of explosive charge means 14 for use in this invention. The charge means preferably comprises a shaped charge including a solid explosive 101 placed in back of conical liner 102 so as to direct the force of the explosion fowardly along the axis 103 of liner 102. An electric blasting cap 104 is provided at the rear of charge 101 to detonate the explosive. Cap 104 is connected to initiating switch 105 through electrically conducting leg wires 106. Switch 105 is operably connected to switch activator 107 through linkage means 08. Activator 107 is caused to operate and change the position of switch 105 upon receiving a signal, which may be electrical or optical, from the individual control unit associated with the charge by way of conductors 15. Upon activation of switch 105, a surge of electric current is supplied to the switch from capacitor discharge blasting machine 110 or similar device through conductor pair 111 and 112.

The entire charge 14 is preferably contained within housing means 113 which functions to protect the charge from damage during transport and placement. It is preferred also that an electromagnetic shielding means 114 be provided to completely surround the charge. Shielding means 114 and housing means 113 may be combined together in a single element.

High frequency radiation from radio transmitters, directional radar antenna, and similar sources will induce a current in any conductor within the radiation field. Such an induced current will generate the same heat in the bridge wire of blasting cap 104 as will a DC current of the same amperage. Because the magnitude of any current induced in the leg wires 106 of cap 104 is dependent upon the length of the leg wires, the length of those leg wires in the embodiment of FIG. 5 is maintained as short as possible. This, coupled with electromagnetic shielding 114, essentially prevents any induced current flow through and heating of the bridge wire of cap 104.

Figure 6A:
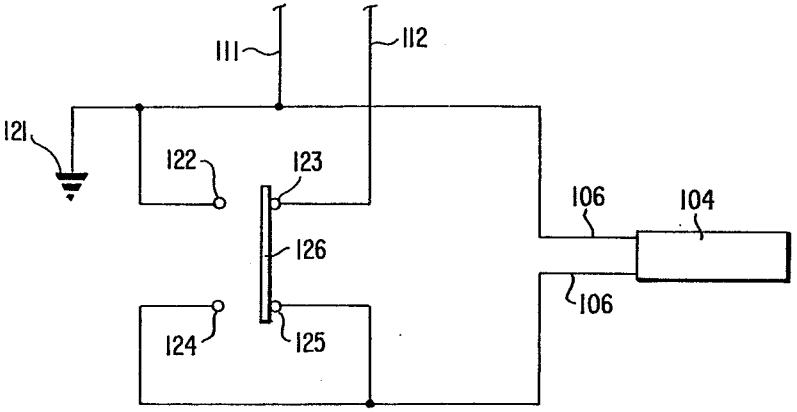
FIG. 6 shows the arrangement of a detonation switch in the deactivated position.
Figure 6:
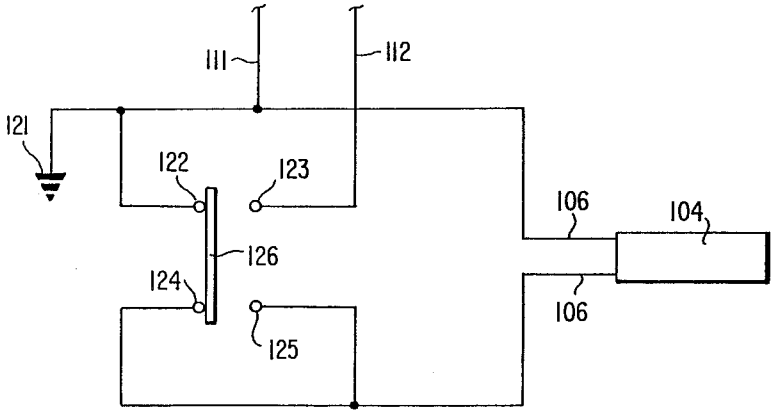

The possibility of the accidental detonation of charge 14 by extraneous electric or electromagnetic energy may be further reduced through use of the switch arrangement diagrammatically illustrated in FIGS. 6 and 6-A. FIG. 6 shows the arrangement of initiating, or detonating, switch 105 in the deactivated position while FIG. 6-A diagrams the same switch in a "fire" position.

Referring to those two Figures in association also with FIG. 5 conductor 111, which is one of the two conductors connecting blasting machine 110 with switch 105, branches to go to ground 121 and to a switch terminal post 122. Another branch of conductor 111 forms one of the leg wires (designated 106 in FIG. 5) of blasting cap 104. The other conductor 112 from blasting machine 110 is directed to switch terminal post 123. The other leg wire 106 of blasting cap 104 branches to form a pair of opposed switch terminal posts 124 and 125.

There is also provided switch contact bar 126 which is movable by switch activator means 107 (FIG. 5) between two positions. In the first position, the deactivated position shown in FIG. 6, contact bar 126 connects switch terminals 122 and 124. As may be appreciated from the diagram, this shorts out and grounds the two leg wires 106 of cap 104 preventing any current flow through the bridge wire of cap 104. In its second position, the "fire" position shown in FIG. 6-A, contact bar 126 connects terminals 123 and 125. This completes a circuit of conductor 111 through blasting cap 104 and returning through conductor 112 thus allowing blasting machine 110 to discharge causing the detonation of cap 104 and explosive 101.

Although the explosive charge 14 was illustrated in FIG. 5 to be of shaped charge configuration, other types of charges may be equally useful depending upon circumstances. A shaped charge, either conical or linear, is most useful for gaining entrance into an enclosure as, for example, detaching a door from its hinges and latches. In other circumstances a charge might be configured to maximize its blast effect to stun and confuse persons in proximity to the charge. Likewise, detonating switches different from that one illustrated in FIGS. 6 and 6-A may be used to advantage.

The conductors 15 connecting each individual control unit 13 with its charge 14 are kept as short as possible so as to minimize induced currents while at the same time allowing the control units to survive the blast without damage.

Other details of design and construction may be modified without departing from the invention set forth in the appended claims.

I claim:

1. A device for remotely detonating explosive charges in environments having high levels of extraneous electricity including stray ground currents, electromagnetic fields and radio frequency energy, comprising:

a command unit adapted to repetitively transmit a sequence of coded commands by radio;

a plurality of explosive charges, each of said charges having an electrically activated detonator;

a plurality of control units, one for each of said charges, each of said control units physically connected to one of said charges by signal transmitting means, said transmitting means having length sufficient to allow each said control unit to survive the detonation of its associated explosive charge, each control unit having decoding, logic and transmission means adapted to receive and decode distinctive radio commands from said command unit, to communicate back to said command unit distinctive coded signals confirming receipt of commands from said command unit, and to send a signal through said transmitting means in response to a particular one such command, said signal causing detonation of said charge; and current flow limiting means adapted to prevent said stray ground currents, electromagnetic fields, radio frequency energy and other extraneous electricity from inducing a current through said electrically activated detonator.

2. The device of claim 1 wherein each said control unit includes means adapted to recognize and discriminate among coded commands from said command unit and, in response to said commands, to cause the status of said control unit to change among inactive, alert, and armed states.

3. The device of claim 2 wherein said command unit is adapted to transmit coded commands comprising separate messages directed to each of said control units; said messages causing selected ones of said control units to change status from an inactive to an alert status and from an alert status to an armed status.

4. The device of claim 3 wherein said logic means of each said control unit are arranged to cause the control unit to revert to an alert status from an armed status if a predetermined time interval passes without the receipt of a new arm command from said command unit.

5. The device of claim 2 wherein said coded signals indicate the status of said control unit as well as confirm receipt of commands from said command unit.

6. The device of claim 3 including a translator unit adapted to relay said coded commands from the command unit to said control units, said translator unit including receiver means to pick up signals from said command unit and re-broadcast said signals to the control units.

7. The device of claim 6 wherein said translator unit also includes means to receive signals broadcast by said control units and to transmit said signals back to said command unit.

8. The device of claim 1 wherein said current flow limiting means includes electromagnetic shielding means surrounding said charge and said detonator.

9. The device of claim 1 wherein said electrically activated detonator is an electric blasting cap and wherein said current flow limiting means includes switch means arranged to connect and ground the two leg wires of said cap when said switch is in a deactivated position.

10. The device of claim 9 wherein said explosive charge, blasting cap and switch means are all arranged within a housing, said housing adapted to shield said blasting cap from electromagnetic radiation.

11. A method for remotely detonating explosive charges in environments having such high levels of extraneous electricity that safety considerations ordinarily require that electric blasting not be attempted comprising:

providing a plurality of explosive charges, each of said charges having an electrically activated detonator;

preventing electrical currents induced by stray ground currents, electromagnetic fields, radio frequency energy and other sources of said extraneous electricity from flowing through said detonator;

coupling the detonator of each said charge to a control unit for said charge, said control unit adapted to receive distinctive coded commands from a command unit, to decode said commands, to communicate back to said command unit a distinctive confirmation that said commands have been received, and to respond to said commands; and causing a surge of current to flow from each said control unit to its coupled detonator upon receipt and confirmation of a coded fire command transmitted to said control unit from said command unit.

12. The method of claim 11 wherein electrical currents are prevented from flowing through said detonator by surrounding said charge and the coupling between the charge and its control unit with an electromagnetic shielding.

13. The method of claim 11 wherein said detonator includes a bridge having leg wires and wherein electrical currents induced by said extraneous electricity are prevented from flowing through said bridge by connecting said leg wires together and to ground.

14. The method of claim 11 wherein each said coded command includes a preamble and a designation code sequence, said designation code sequence being unique to each control unit.

15. The method of claim 14 wherein said designation code sequence is a prime number.

16. The method of claim 14 wherein a first said coded command designates a control unit to be placed on an alert status and wherein said control unit transmits a message back to said command unit affirming the change in status of the control unit.

17. The method of claim 16 wherein a second said coded command designates a control unit which is on an alert status to go to an armed status in which state it can accept and act upon a third said coded command causing said control unit to detonate its coupled charge.

18. The method of claim 17 wherein said control unit reverts from the armed status back to an alert status in the event that a repeat of said second coded command is not received within a predetermined time interval.

19. The method of claim 17 in which said control unit repeatedly transmits a message back to said command unit affirming its change from an alert to an armed status.

* * * * *